US005791527A

United States Patent [19]

Giuffredi

[11] Patent Number: 5,791,527

[45] Date of Patent: Aug. 11, 1998

[54] LIQUID VAPORIZER WITH FILLER PLUG

[75] Inventor: Giancarlo Giuffredi, Milan, Italy

[73] Assignee: Coster Technologie Speciali S.p.A., Trento, Italy

[21] Appl. No.: 662,846

[22] Filed: Jun. 12, 1996

[30] Foreign Application Priority Data

Jul. 11, 1995 [IT] Italy ..... MI950492 U

[51] Int. Cl.[6] ..... B65B 3/04

[52] U.S. Cl. ..... 222/321.9; 222/385; 222/482; 222/525; 141/20; 141/113; 141/327

[58] Field of Search ..... 222/321.1, 321.2, 222/321.6, 321.7, 321.9, 383.1, 385, 522, 524, 525, 482; 141/3, 20, 113, 326, 327

[56] References Cited

U.S. PATENT DOCUMENTS

| | | | |
|---|---|---|---|
| 962,682 | 6/1910 | Wade | 222/383.1 |
| 2,888,176 | 5/1959 | Miller | 222/482 |
| 3,181,737 | 5/1965 | Chaucer | 141/20 |
| 3,276,640 | 10/1966 | Kessler | 222/525 |
| 3,294,294 | 12/1966 | Amburgey | 222/525 |
| 3,511,420 | 5/1970 | Kessler | 222/525 |
| 3,738,545 | 6/1973 | Roy | 222/525 |
| 4,705,191 | 11/1987 | Itzel et al. | 222/383.1 |
| 4,896,799 | 1/1990 | Giuffredi | 222/321.2 |
| 4,988,017 | 1/1991 | Schrader et al. | 141/20 |
| 5,472,112 | 12/1995 | Maciejewski | 141/327 |
| 5,645,113 | 7/1997 | Humm et al. | 141/3 |

*Primary Examiner*—J. Casimer Jacyna
*Attorney, Agent, or Firm*—Steinberg & Raskin, P.C.

[57] ABSTRACT

The vaporizer comprises a casing (1A) of moulded plastics, an atomizing pump non-removably mounted in the upper part of the casing, and a plug (29A) mounted in the lower part of the casing. The plug (29A) is provided with channels (30A) through which the liquid product is loaded when the plug is in a first position (FIG. 1); when the plug (29A) is urged into a second position (FIG. 2) the channels (30A) are blocked to trap the loaded liquid product in the casing.

8 Claims, 2 Drawing Sheets

LIQUID VAPORIZER WITH FILLER PLUG

FIELD OF THE INVENTION

This invention relates to a vaporizer of very, small dimensions, to be disposed of after the contained dose of liquid product has been consumed. It comprises a casing to contain the product to be vaporized, for example perfume, and an atomizing pump for evaporating the product.

BACKGROUND OF THE INVENTION

Conventional vaporizers comprise a container provided with an opening through which a metered quantity of liquid product is fed. When filling is complete the opening is closed by mounting the atomizing pump thereon, this being retained in place by forcing, by a thread or by clinching a metal cap. The main drawback of this procedure is that in addition to carrying out the filling, the purchaser of the vaporizer, who is generally the perfume producer, has to manipulate and mount the pump with the container full, with the risk of spilling the product and in any event requiring machines of a certain complexity.

OBJECTS AND SUMMARY OF THE INVENTION

An object of the present invention is to provide a small dimension vaporizer which can be filled with the product dose after the pump has been mounted.

This and further objects which will be apparent from the detailed description given hereinafter are attained by a vaporizer in accordance with the accompanying claims.

BRIEF DESCRIPTION OF THE DRAWINGS

The invention will be more apparent from the description thereof given hereinafter by way of non-limiting example with reference to the accompanying drawing, in which.

DETAILED DESCRIPTION OF THE INVENTION

Figure 1:
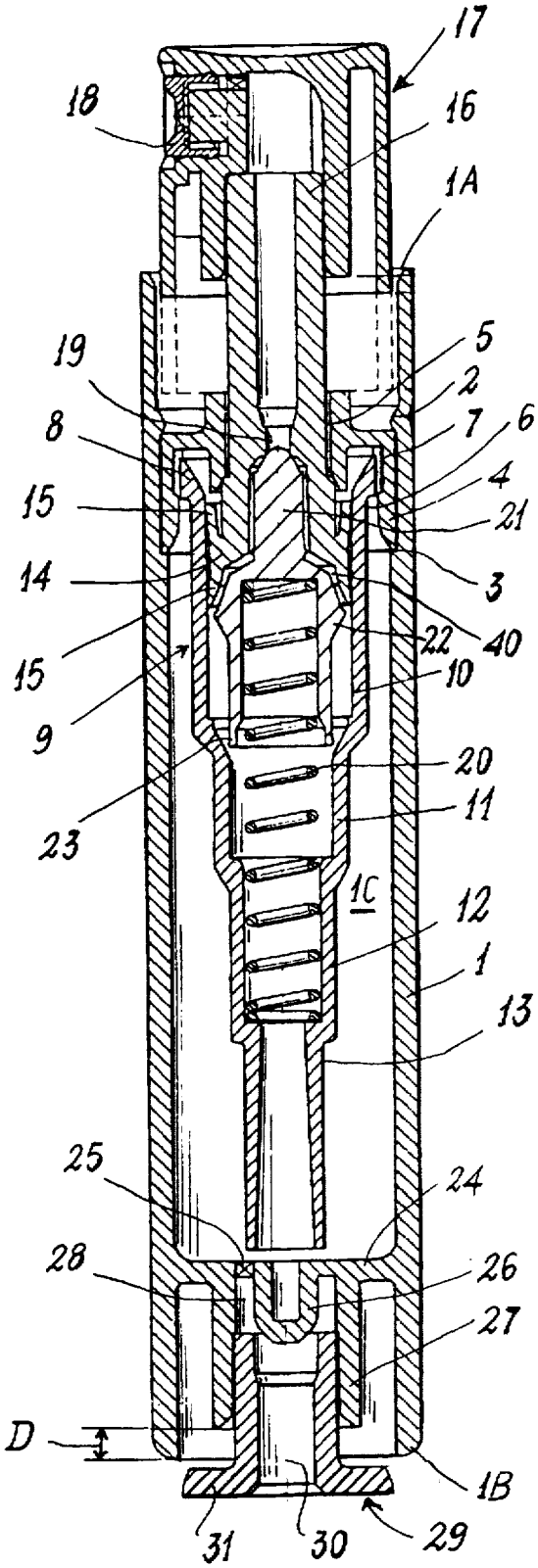
FIG. 1 is an axial section through a vaporizer with its plug mounted in the position which allows product filling; the manufacturer supplies the vaporizer in this configuration to the firm which is to fill it with the product.

It should firstly be noted that the atomizing pump used in the vaporizer of the invention can be of any known type. It can therefore be either of the types described hereinafter or of the types described for example in U.S. Pat. No. 4,896,799 and 5,002,207.

In the figures the reference numeral 1 indicates the cylindrical casing of the vaporizer.

The cylindrical casing comprises two spaced-apart annular projections 2, 3 on its upper part.

The upper annular projection 2 is positioned a certain distance from the upper end 1A of the casing and is shaped as a lead-in.

The lower projection 3 is formed as a flat step of transition from one thickness to another greater thickness of the inner wall of the casing.

An annular guide member 4 having a central hole 5 and a partially annular internal compartment 6 connected to said hole is positioned between the two projections. In the wall or base wall of the annular compartment there is provided an annular depression 7 in which there engages the outer end 8 of a tubular member 9 comprising, from the top downwards, four sections 10, 11, 12, 13 of decreasing diameter. The first section 10 forms the cylinder for an axially hollow first piston 14 provided with elastic seal lips 15 and an axially hollow stem 16 on which a conventional dispensing cap 17 carrying a usual spray nozzle 18 is forced.

Within the stem 16 there is a constriction 19 against which a valving element 21 adheres, urged by a compression spring 20. The valving element and the cooperating constriction form the delivery valve of the vaporizer pump, this pump comprising said piston 14.

With the valving element 21 there is rigid an annular skirt 22 within which the upper end of the compression spring 20 is positioned. During the pumping movement, the skirt 22 penetrates into the second section 11 of the tubular member 9, and slides in a sealed manner therein.

The skirt 22 with its lower edge 23 and the interior contour of the second section 11 form the suction valve.

The third section 12 of the tubular member acts as a spring guide, the lower end of the compression spring 20 acting on its bottom step.

The fourth section 13 acts as a dip tube for the liquid.

In the lower part of the casing 1, at a certain distance from its lower end 1B, there is a transverse wall 24 bounding the compartment IC in which the liquid product to be dispensed is placed. The wall 24 comprises a hole 25 in an eccentric position and a downwardly extending projection 26 in a central position. The projection 26 is surrounded at a certain distance by a downwardly extending concentric cylindrical skirt 27. This skirt extends to a distance D from the lower end 1B of the casing 1. Said hole 25 opens into the interspace 28 between the projection 26 and the skirt 27.

Within the skirt 27 there is sealedly mounted a plug 29 provided with an axial hole 30 and a head 31, its height being slightly less than D so that when the plug is completely inserted (FIG. 2) it does not project from the lower end 1B of the casing 1.

The vaporizer is supplied by the manufacturer to the purchaser who is required to fill it with the liquid product when in the configuration of FIG. 1 (ie with the pump mounted), in which the plug 29 is only partially inserted so as to leave a passage between its hole 30 and the hole 25 provided in the transverse wall 24, this passage enabling the product to be loaded into the vaporizer through the plug. Having loaded the required dose of product, the plug 29 is pressed right down (FIG. 2) so that its hole 30 becomes engaged by the projection 26, so sealedly blocking said passage.

With regard to the pump operation, it should firstly be noted that when in the blocked position of FIG. 1, between the valving element 21 and part of the skirt 22 on one side and the piston 14 on the other side there is an interspace 40. It will now be assumed that the product is to be dispensed. The cap 17 is pressed downwards by the user. The piston 14 moves downwards as does the valving element 21 with the skirt 22, which passes into the second section 11 of the member 9. Because of the difference in the diameters of the first section 10 and the second section 11 of the tubular member 9, at a certain moment the pressure of the liquid trapped between the piston 14 and the valving element 21 plus skirt 22 overcomes the reaction of the spring 20, with the result that the valving element 21 withdraws from the constriction 19, so that the liquid product leaves through the hollow stem to reach the nozzle 18 from which it leaves in atomized form. On releasing the cap 17 the spring 20 returns the entire assembly into the starting position of FIG. 1, by which new liquid is drawn by suction into the interior of the pump.

Figure 2:
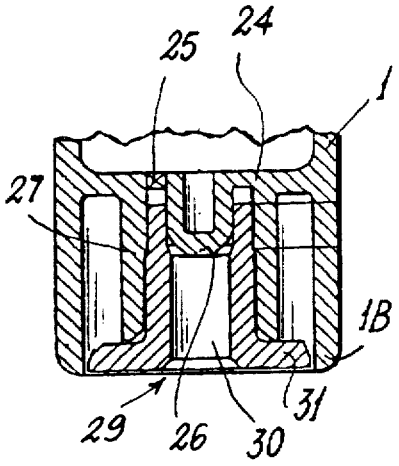
FIG. 2 is a detailed section showing the plug in its closed position, ie when filling is complete.
Figure 3:
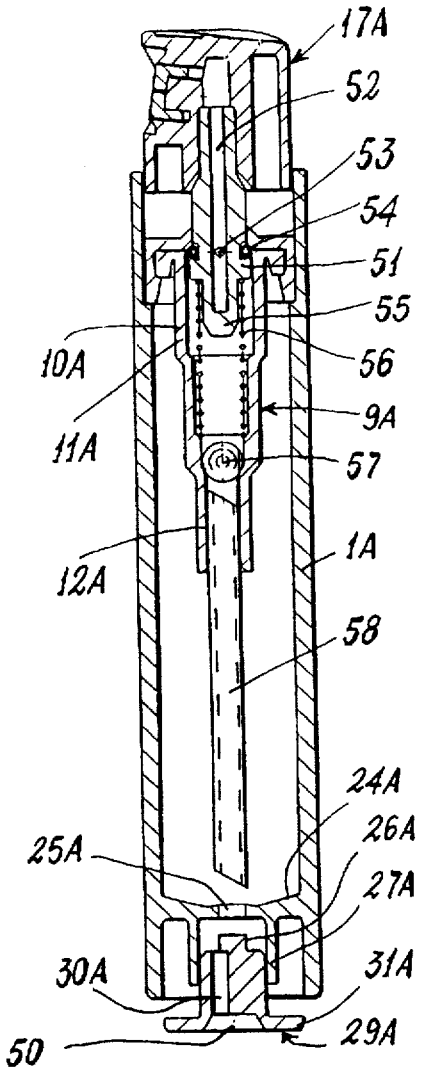
FIG. 3 is an axial section through a modified vaporizer.
Figure 4:
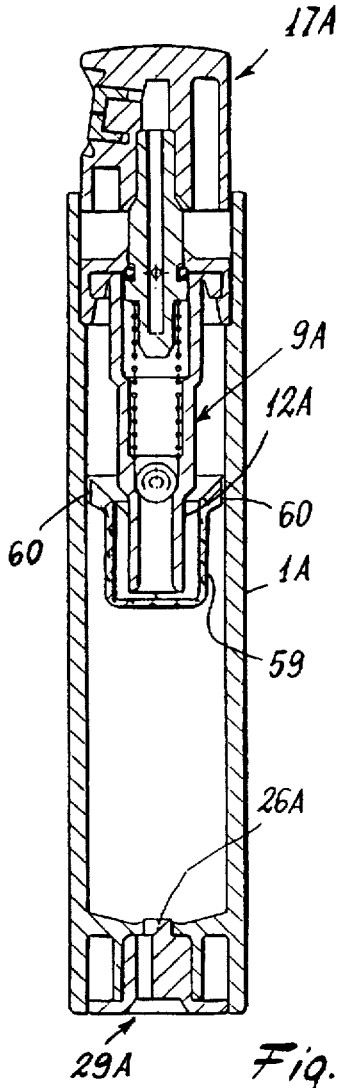
FIG. 4 is an axial section through a further modified vaporizer.

In the two embodiments of FIGS. 3 and 4 a known atomizing pump is used, but which is different from that of FIGS. 1 and 2.

In these two embodiments, in which parts identical to or corresponding with those of FIGS. 1 and 2 carry the same reference numerals plus the letter A, the base wall 24A comprises a central hole 25A. The projection which in FIGS. 1 and 2 forms part of the base wall 24A is provided on the plug and is indicated by 26A. The purpose of the projection 26A is to block the hole 25A when the plug 29A is pushed right down (see FIG. 4). The plug, which is of a softer material than the casing 1A, has a series of passages 30A provided angularly spaced apart and opening into a flared hole 50 present in the head 31A.

The atomizing pumps of FIGS. 3 and 4 are identical and comprise the tubular member 9A which in this case has three zones 10A, 11A and 12A of different diameter. In the first there is slidingly mounted in a sealed manner a piston 51 comprising a dead axial liquid exit hole 52 into which there open radial passages 53 which, when the pump is in the position shown in the figure, are blocked by an annular gasket 54. The piston also comprises a lower projection 55 subjected to the thrust of a compression spring 56. A ball 57 acts as the suction valve.

In the embodiment of FIG. 3, within the smallest-diameter section 12A of the member 9A there is mounted a dip tube 58. In the embodiment of FIG. 4 the dip tube is replaced by a bowl 59 located at the level of the third section 12A and surrounding this latter at a certain distance therefrom. The bowl is forced into the casing 1A and peripherally comprises axial channels 60.

The embodiment of FIG. 4 takes account of the fact that because vaporizers used for perfume and the like are long and narrow they have difficulty in remaining upright, and assume a horizontal position in handbags with possible resultant difficulty in dispensing the product. In the embodiment of FIG. 4 the bowl 59 is filled via the channel 60 when the vaporizer is horizontal, and can hence quickly dispense the product when the cap 17A is pressed. This embodiment also enables container casings 1A of different lengths (and hence capacities) to be used without having to provide the pump with a dip tube of adequate length.

On pressing the cap 17A, the liquid product trapped between the piston 51 and ball 57 is pressurized and is dispensed when the radial apertures 53 disengage from the gasket 54 which is located in an annular groove of piston 51 where the radial holes 53 emerge, the annular groove having such an axial length that on the pumping stroke the gasket moves upwards in the groove freeing the radial holes and viceversa in the opposite stroke. During the return travel under the thrust of the spring 56, the vacuum which is produced causes new product to flow through the suction valve (ball 57).

I claim:

1. A liquid vaporizer comprising a casing for containing the liquid, a manual pump carried by said casing, and a presser member connected to the pump to operate it and deliver the liquid in vaporized form, characterized in that in the lower part thereof distant from said presser member, said casing comprises a communication path with the outside in which there is mounted a ducted plug which can assume two different positions, namely a first position in which the relative ducting communicates with this communication path so as to enable the liquid to be loaded into the casing through the plug, and a second position in which this communication path is blocked, the communication path comprising at least one hole in a base wall of the casing and a skirt within which the plug is received and wherein the hole is eccentric, and the skirt surrounds a projection from the base wall of the casing, said projection blocking the plug ducting.

2. A liquid vaporizer, comprising:

a casing receivable of the liquid having an upper part and a lower part closed by a base wall having an eccentric hole formed therein, a manual pump arranged in said casing, a presser member arranged in the upper part of said casing and connected to said pump, said presser member being structured and arranged to operate said pump and dispense the liquid in vaporized form, a projection extending outward from said base wall of said casing, a skirt surrounding said projection and defining a space between said skirt and said projection, said casing hole opening into the space, and a ducted plug having a duct, at least a portion of said plug being received within said skirt and said plug having a first position in which the duct of said plug is in fluid communication with the casing hole to enable the liquid to be loaded into said casing through the duct of said plug and a second position in which the casing hole is blocked by said plug and the duct of said plug is blocked by said projection.

3. The liquid vaporizer of claim 2, wherein said projection is situated in the center of said base wall.

4. The liquid vaporizer of claim 2, wherein said skirt is substantially cylindrical and concentric with said projection.

5. The liquid vaporizer of claim 2, wherein the aperture of said plug is formed axially with respect to said plug.

6. A liquid vaporizer, comprising:

a casing receivable of the liquid having an open upper part and a lower part closed by a base wall, a manual pump arranged in said casing, a presser member arranged in the upper part of said casing and connected to said pump, said presser member being structured and arranged to operate said pump and dispense the liquid in vaporized form, and a ducted plug, one of said plug and said base wall having an eccentric hole and a central projection, the other of said plug and said base wall having a central hole, said plug having a first position in which the eccentric hole is in fluid communication with the central hole to enable the liquid to be loaded into said casing and a second position in which the eccentric hole and the central hole are blocked.

7. The liquid vaporizer of claim 6, wherein the central hole is formed in said base wall and the eccentric hole and central projection are formed in said plug.

8. The liquid vaporizer of claim 7, wherein in the second position, the eccentric hole is blocked by said base wall and the central hole is blocked by said central projection.

* * * * *

UNITED STATES PATENT AND TRADEMARK OFFICE

CERTIFICATE OF CORRECTION

PATENT NO. : 5,791,527

DATED : August 11, 1998

INVENTOR(S) : Giancarlo GIUFFREDI

It is certified that error appears in the above-identified patent and that said Letters Patent is hereby corrected as shown below:

On the cover page next to [73] Assignee:

Change "Coster Technologie Speciali S.p.A. to –Coster Tecnologie Speciali S.p.A.--

Signed and Sealed this

Tenth Day of August, 1999

*Attest:*

Q. TODD DICKINSON

*Attesting Officer*

*Acting Commissioner of Patents and Trademarks*